United States Patent [19]

Joly et al.

[11] Patent Number: 5,017,468

[45] Date of Patent: May 21, 1991

[54] PROCESS FOR THE PREPARATION OF SILVER HALIDE EMULSIONS

[75] Inventors: Ludovicus P. Joly, Hove; Antonius A. Rutges, Boechout, both of Belgium

[73] Assignee: Agfa-Gevaert, N.V., Mortsel, Belgium

[21] Appl. No.: 480,978

[22] Filed: Feb. 16, 1990

[30] Foreign Application Priority Data

Feb. 17, 1989 [EP] European Pat. Off. ... EP89200381.5

[51] Int. Cl.[5] ..... G03C 1/02

[52] U.S. Cl. ..... 430/569; 430/567

[58] Field of Search ..... 430/569, 567

[56] References Cited

U.S. PATENT DOCUMENTS 3,917,485 11/1975 Morgan ..... 430/606
4,496,652 1/1985 Haugh et al. ..... 430/569
4,769,315 9/1988 Suda et al. ..... 430/569

FOREIGN PATENT DOCUMENTS 0072217 2/1983 European Pat. Off. ..... 430/567

*Primary Examiner*—Charles L. Bowers, Jr.
*Assistant Examiner*—Thomas R. Neville
*Attorney, Agent, or Firm*—Breiner & Breiner

[57] ABSTRACT

A method is disclosed for preparing silver halide emulsions useful in photography. Said method comprises the step of precipitating silver halide grains in an aqueous solution of peptizer initially and finally under pAg values suitable for forming cubic silver halide crystals characterized in that at least once during the precipitation stage the pAg is increased for at least 10 percent by weight of the total amount of silver salt used during the precipitation by at least 1.5 units to such value whereby the formation of octahedral crystals would occur if that value were to persist over the entire precipitation stage.

Preferably the increase of the pAg value is brought about after precipitation of between ten and twenty percent of the total amount of silver halide to be precipitated.

10 Claims, No Drawings

PROCESS FOR THE PREPARATION OF SILVER HALIDE EMULSIONS

DESCRIPTION

The present invention relates to a process for the preparation of novel silver halide emulsions, more in particular to a novel precipitation method for silver halide crystals and their use in photographic film.

As is generally known regular-shaped silver halide crystals useful in photography may be prepared by employing a technique known as balanced double jet precipitation wherein separate streams of silver nitrate and alkali metal halide are introduced into a stirred gelatin solution and the process is controlled to regulate the form of the resulting silver halide crystals.

By partially or fully controlling the conditions of temperature, concentrations, sequence of addition, and rates of addition it is possible to grow uniform particles of regular crystalline form such as cubic or octahedral form or any transition form.

The formed particles also may have an irregular crystalline form such as a spherical form or a tabular form, or they may have a composite crystal form comprising a mixture of said regular and irregular crystalline forms.

The silver halide grains may also have a multilayered grain structure. According to a simple embodiment the grains may comprise a core and a shell, which may have different halide compositions and/or may have undergone different modifications such as the addition of dopes.

It is an obJect of this invention to provide a process for preparing silver halide emulsions with novel silver halide crystal structure which structure results in beneficial photographic properties.

It is a further object of this invention to provide either negative or positive working photographic silver halide materials, employing emulsions with the aforesaid novel crystal or grain structure having improved photographic properties. Other objects will become apparent from the description hereinafter.

According to the present invention we therefore provide a method for preparing a silver halide emulsion which comprises the step of precipitating silver halide grains in an aqueous solution of peptizer initially and finally under pAg values suitable for forming cubic silver halide crystals, characterised in that at least once during the precipitation stage the pAg is increased for at least 10 percent by weight of the total amount of silver salt used during the precipitation by at least 1.5 units to such value whereby the formation of octahedral crystals would occur if that value were to persist over the entire precipitation stage.

According to a preferred embodiment of the process according to the present invention, the increase of the pAg value is brought about after precipitation of between ten and twenty percent of the total amount of the silver halide to be precipitated.

A further preferred embodiment of the process according to the present invention involves the preparation of silver halide crystals, preferably predominantly silver iodobromide crystals by precipitation under balanced double jet conditions and the subsequent treatment of such crystals with a sulphur or gold sensitizer to produce crystals suitable for inclusion in a high speed negative emulsion.

We have noted that photographic materials containing silver halide emulsions prepared in accordance with the present invention feature not only the beneficial photographic property that their sensitometric values, in particular their gamma and Dmax values have favourably low dependence on development processing times but also have a favourably low fog value. The beneficial photographic properties of the materials prepared in accordance with our invention in comparison with photographic materials containing e.g. substantially cubic crystals are illustrated by the experimental results set forth hereinafter.

The parameter according to which preferentially cubic, resp. octahedral crystals may be formed during the precipitation stage of the photographic emulsion making is the pAg of the solution.

The pAg of the solution may be regulated by any of the means known in the art of emulsion making, such as the electronic control apparatus and method disclosed in U.S. Pat. No. 3,821,002.

From the article "Der EinfluB der Wachstumsbedingungen auf die Kristalltracht der Silberhalogenide" (the influene of Growth Conditions on the Crystalline Behaviour of Silver halides) von E.Moisar and E.Klein. Bunsengesellschaft für physikalische Chemie, Berichte 67 949–957 (1963) No 9.10., it is known that on allowing tetradecahedral crystals of a homodisperse silver bromide emulsion to grow by controlled addition of solutions of $AgNO_3$ and KBr, crystals of cubic form are obtained under conditions of low excess bromide concentration in the solution phase. With increasing excess of bromide (111) surfaces are preferentially developed, and ultimately pure octahedral growth is observed.

The pAg-values yielding cubic, resp. octahedral crystals depend on the temperature. In Table I the pAg-neutrality values are set forth for various temperatures, as well as the values for the formation of resp. cubic and octahedral crystals at these temperatures, which are above the pAg-neutrality values. The last column gives the 'change-over pAg value', i.e. the arithmetical average between the pAg values for cubic and octahedral crystal formation. Around these pAg values the crystal formation balances between cubic and octahedral structure.

As will be disclosed in further details in the Examples set forth hereinafter, pAg cycling for obtaining cubic resp. octahedral crystals is contemplated at all temperatures with 1 to 2 pAg units around the so-called change-over pAg value. Since all pAg cycling takes place above and not both above and below pAg neutrality, the present invention is clearly different from the prior art such as U.S. Pat. No. 3,917,485 contemplating one or more pAg cycles on each side of pAg neutrality. In said US Patent a method for making an internally sensitive photographic silver halide emulsion is disclosed whereby further silver halide is laid down on the grains of a surface sensitive or surface fogged emulsion so that excesses of silver and halide ions are alternately produced. As an example, sufficient silver nitrate solution is added to the precipitation solution to adjust the pAg of the emulsion to the silver side, e.g. to a pAg of 5.0, then sufficient potassium halide solution is added to adjust the pAg of the emulsion to the halide side, e.g. to a pAg of 8.0, and this pAg adjustment cycle may be repeated several times. When applying this method, the shift in the neutral pAg of the precipitation solution as a function of temperature, as described hereinbefore, must also be considered when choosing the pAg levels in cycling.

Generally cycling of at least one pAg unit and, preferably, two pAg units on either side of pAg neutrality is contemplated in said patent specification.

According to a preferred embodiment of the present invention, the initial and final pAg value is situated one to two units below the change-over value and the pAg value is increased at least once during the precipitation stage to one to two units above the change-over value.

According to a further preferred embodiment of the present invention the initial and final pAg value is situated between 6.5 and 8 and is increased at least once during the precipitation stage to a value situated between 8.5 and 11.

According to a further preferred embodiment of the present invention the increase of the pAg value is brought about after precipitation of between ten and twenty percent of the total amount of silver halide to be precipitated and according to another preferred embodiment, the pAg value is alternatively increased, resp. decreased each time after precipitation of between ten and twenty percent of the total amount of silver halide to be precipitated.

The silver halide emulsions formed according to the pAg cycling method of the present invention may comprise any of the silver halides generally employed in silver halide photography e.g. silver chloride, silver bromide, silver chlorobromide, silver chlorobromoiodide, silver chloroiodide, silver bromoiodide and the like. Preferred silver halide emulsions comprise at most 10 mole% of iodide. The method of the present invention is particularly valuable for the formation of high-sensitive silver bromide or silver bromoiodide emulsions e.g. X-ray emulsions. The average grain-size of the silver halide emulsions made according to the present invention may vary between wide limits and depends on the intended use for the emulsion. Fine grain as well as coarse-grain emulsions can be made according to the present invention. Particle size of silver halide grains can be determined using conventional techniques e.g. as described by Trivelli and M.Smith, The Photographic Journal, vol. 69, 1939, p. 330–338 Loveland "ASTM symposium on light microscopy" 1953, p. 94–122 and Mees and Jones "The Theory of the photographic process" (1977), Chapter II.

Monodispersed as well as heterodispersed emulsions can be made according to the present invention, monodispersed emulsions being, however, preferred. Monodispersed emulsions in contrast to heterodispersed emulsions have been characterized in the art as emulsions of which at least 95 % by weight or number of the grains have a diameter which is within about 40 %, preferably within about 30 % of the mean grain-diameter.

Silver halide grains having a narrow grain-size distribution can be obtained by controlling the conditions at which the silver halide grains are prepared using a double run procedure. In such a procedure, the silver halide grains are prepared by simultaneously running an aqueous solution of a water-soluble silver salt for example, silver nitrate, and a water-soluble halide, for example, an alkali metal halide such as potassium bromide, into a rapidly agitated aqueous solution of a silver halide peptizer, preferably gelatin, a gelatin derivative or some other protein peptizer.

Once the grains have reached their ultimate size and shape, the emulsions are generally washed to remove the by-products of grain-formation and grain-growth.

The emulsions may be chill-set, shredded and washed by leaching in cold water, or they may be washed by coagulation.

In accordance with the present invention, the emulsions are preferably washed by acid-coagulation techniques using acid-coagulable gelatin derivatives or anionic polymeric compounds.

Coagulation techniques using acid-coagulable gelatin derivatives have been described e.g. in U.S. Pat. Nos. 2,614,928, 2,614,929 and 2,728,662. The acid-coagulable gelatin derivatives are reaction products of gelatin with organic carboxylic or sulphonic acid chlorides, carboxylic acid anhydrides, aromatic isocyanates or 1,4-diketones. The use of these acid-coagulable gelatin derivatives generally comprises precipitating the silver halide grains in an aqueous solution of the acid coagulable gelatin derivative or in an aqueous solution of gelatin to which an acid coagulable gelatin derivative has been added in sufficient proportion to impart acid-coagulable properties to the entire mass. Alternatively, the gelatin derivative may be added after the stage of emulsification in normal gelatin, and even after the physical ripening stage, provided it is added in an amount sufficient to render the whole coagulable under acid conditions. Examples of acid-coagulable gelatin derivatives suitable for use in accordance with the present invention can be found e.g. in the United States Patent Specifications referred to above. Particularly suitable are phthaloyl gelatin and N-phenylcarbamoyl gelatin.

It is also possible to wash the emulsion by coagulation techniques using anionic polymeric compounds. Such techniques have been described e.g. in German Patent 1,085,422. Particularly suitable anionic polymeric compounds are polystyrene sulphonic acid and sulphonated copolymers of styrene. The anionic polymers can be added to the gelatin solution before precipitation of the silver halide grains or after the stage of emulsification. They are preferably added after the grains have reached their ultimate size and shape, i.e. just before washing. It is also possible to use anionic polymers in combination with acid-coagulable gelatin derivatives as described in the published German Patent Specification No. 2,337,172 (DOS). It is preferred to use low-molecular weight polystyrene sulphonic acid having a molecular weight of at most 30,000. The polystyrene sulphonic acid can be added to the gelatin solution from aqueous solutions preferably comprising from 5 to 20 % by weight of polystyrene sulphonic acid. The amounts used suffice to impart coagulation properties to the emulsion and can easily be determined by those skilled in the art.

After the emulsification and physical ripening stage, the silver halide emulsion comprising acid-coagulable gelatin derivative or anionic polymer is acidified e.g. by means of dilute sulphuric acid, citric acid, acetic acid, etc. so as to effect coagulation. Coagulation generally occurs at a pH value comprised between 3 and 4. The coagulum formed may be removed from the liquid by any suitable means, for example the supernatant liquid is decanted or removed by means of a siphon, where upon the coagulum is washed out once or several times.

Washing of the coagulum may occur by rinsing with mere cold water. However, the first wash water is preferably acidified to lower the pH of the water to the pH of the coagulation point. Anionic polymer e.g. polystyrene sulphonic acid may be added to the wash water even when an acid coagulable gelatin derivative has been used e.g. as descried in published German Patent Specification (DOS) 2,337,172 mentioned hereinbefore. Alternatively washing may be effected by redispersing the coagulum in water at elevated temperature using a small amount of alkali, e.g. sodium or ammonium hydroxide, recoagulating by addition of an acid to reduce the pH to the coagulation point and subsequently removing the supernatant liquid. This redispersion and recoagulation operation may be repeated as many times as is necessary.

After the washing operation, the coagulum is redispersed to form a photographic emulsion suitable for the subsequent finishing and coating operations by treating, preferably at a temperature within the range of 35 to 70° C., with the required quantity of water, normal gelatin and, if necessary, alkali for a time sufficient to effect a complete redispersal of the coagulum.

Washing of the emulsion may also be effected by using ultracentrifugal techniques.

Instead or in addition to normal gelatin, which is preferably used, other known photographic hydrophilic colloids can also be used for redispersion e.g. a gelatin derivative as referred to above, albumin, agar-agar, sodium alginate hydrolysed cellulose esters, polyvinyl alcohol, hydrophilic polyvinyl copolymers, etc.

The light-sensitive silver halide emulsion can be chemically sensitized as described i.a. in the above-mentioned "Chimie et Physique Photographique" by P. Glafkides. in the above-mentioned "Photographic Emulsion Chemistry" by G.F. Duffin, in the above-mentioned "Making and Coating Photographic Emulsion" by V.L. Zelikman et al. and in "Die Grundlagen der Photographischen Prozesse mit Silberhalogeniden" edited by H. Frieser and published by Akademische Verlagsgesellschaft (1968). As described in said literature chemical sensitization can be carried out by effecting the ripening in the presence of small amounts of compounds containing sulphur e.g. thiosulphate, thiocyanate, thioureas, sulphites, mercapto compounds, and rhodamines. The emulsions can be sensitized also by means of gold-sulphur ripeners or by means of reductors e.g. tin compounds as described in GB-A 789,823, amines, hydrazine derivatives, formamidine-sulphinic acids, and silane compounds. Chemical sensitization can also be performed with small amounts of Ir, Rh, Ru, Pb, Cd, Hg, Tl, Pd, Pt, or Au. One of these chemical sensitization methods or a combination thereof can be used.

The light-sensitive silver halide emulsions can be spectrally sensitized with methine dyes such as those described by F.M. Hamer in "The Cyanine Dyes and Related Compounds", 1964, John Wiley & Sons. Dyes that can be used for the purpose of spectral sensitization include cyanine dyes, merocyanine dyes, complex cyanine dyes, complex merocyanine dyes, holopolar cyanine dyes, hemicyanine dyes, styryl dyes and hemioxonol dyes. Particularly valuable dyes are those belonging to the cyanine dyes, merocyanine dyes, complex merocyanine dyes.

Other dyes, which per se do not have any spectral sensitization activity, or certain other compounds, which do not substantially absorb visible radiation, can have a supersensitization effect when they are incorporated together with said spectral sensitizing agents into the emulsion. Suitable supersensitizers are i.a. heterocyclic mercapto compounds containing at least one electronegative substituent as described e.g. in U.S. Pat. No. 3,457,078, nitrogen-containing heterocyclic ring-substituted aminostilbene compounds as described e.g. in U.S. Pat. No. 2,933,390 and U.S. Pat. No. 3,635,721, aromatic organic acid/formaldehyde condensation products as described e.g. in U.S. Pat. No. 3,743,510, cadmium salts, and azaindene compounds.

Although the silver halide emulsions for use in accordance with the present invention are characterised by low fog values, compounds for preventing the formation of fog or stabilizing the photographic characteristics during the production or storage of photographic elements or during the photographic treatment thereof may be supplementary added. Many known compounds can be added as fog-inhibiting agent or stabilizer to the silver halide emulsion. Suitable examples are i.a. the heterocyclic nitrogen-containing compounds such as benzothiazolium salts, nitroimidazoles, nitrobenzimidazoles, chlorobenzimdazoles, bromobenzimidazoles, mercaptothiazoles, mercaptobenzothiazoles, mercaptobenzimidazoles, mercaptothiadiazoles, aminotriazoles benzotriazoles (preferably 5-methyl-benzotriazole), nitrobenzotriazoles, mercaptotetrazoles, in particular 1-phenyl-5-mercapto-tetrazole, mercaptopyrimidines, mercaptotriazines, benzothiazoline-2-thione, oxazoline-thione, triazaindenes, tetrazaindenes and pentazaindenes, especially those described by Birr in Z. Wiss. Phot. 47 (1952), pages 2–58, triazolopyrimidines such as those described in GB-A 1,203,757, GB-A 1,209,146, JA-Appl. 75-39537, and GB-A 1,500,278, and 7-hydroxy-s-triazolo-[1,5-a]-pyrimidines as described in U.S. Pat. No. 4,727,017, and other compounds such as benzenethiosulphonic acid, benzenethiosulphinic acid, benzenethiosulphonic acid amide. Other compounds that can be used as fog-inhibiting compounds are metal salts such as e.g. mercury or cadmium salts and the compounds described in Research Disclosure N° 17643 (1978), Chapter VI.

The fog-inhibiting agents or stabilizers can be added to the silver halide emulsion prior to, during, or after the ripening thereof and mixtures of two or more of these compounds can be used.

The binders of the photographic element, especially when the binder used is gelatin, can be hardened with appropriate hardening agents such as those of the epoxide type, those of the ethylenimine type, those of the vinylsulfone type e.g. 1,3-vinylsulphonyl-2-propanol, chromium salts e.g. chromium acetate and chromium alum, aldehydes e.g. formaldehyde, glyoxal, and glutaraldehyde, N-methylol compounds e.g. dimethylolurea and methyloldimethylhydantoin, dioxan derivatives e.g. 2,3-dihydroxy-dioxan, active vinyl compounds e.g. 1,3,5-triacryloyl-hexahydro-s-triazine, active halogen compounds e.g. 2,4-dichloro-6-hydroxy-s-triazine, and mucohalogenic acids e.g. mucochloric acid and mucophenoxychloric acid. These hardeners can be used alone or in combination. The binders can also be hardened with fast-reacting hardeners such as carbamoylpyridinium salts.

The photographic element of the present invention may further comprise various kinds of surface-active agents in the photographic emulsion layer or in at least one other hydrophilic colloid layer. Suitable surface-active agents include non-ionic agents such as saponins alkylene oxides e.g. polyethylene glycol, polyethylene glycol/polypropylene glycol condensation products, polyethylene glycol alkyl ethers or polyethylene glycol alkylaryl ethers, polyethylene glycol esters, polyethylene glycol sorbitan esters, polyalkylene glycol alkylamines or alkylamides, silicone-polyethylene oxide adducts glycidol derivatives, fatty acid esters of polyhydric alcohols and alkyl esters of saccharides; anionic agents comprising an acid group such as a carboxy, sulpho, phospho, sulphuric or phosphoric ester group; ampholytic agents such as aminoacids, aminoalkyl sulphonic acids, aminoalkyl sulphates or phosphates, alkyl betaines, and amine-N-oxides; and cationic agents such as alkylamine salts, aliphatic, aromatic, or heterocyclic quaternary ammonium salts, aliphatic or heterocyclic ring-containing phosphonium or sulphonium salts. Such surface-active agents can be used for various purposes e.g. as coating aids, as compounds preventing electric charges, as compounds improving slidability, as compounds facilitating dispersive emulsification, as compounds preventing or reducing adhesion, and as compounds improving the photographic characteristics e.g higher contrast, sensitization, and development acceleration.

Development acceleration can be accomplished with the aid of various compounds, preferably polyalkylene derivatives having a molecular weight of at least 400 such as those described in e.g. U.S. Pat. Nos. 3,038,805 - 4,038,075 - 4,292,400.

The photographic element of the present invention may further comprise various other additives such as e.g. compounds improving the dimensional stability of the photographic element, UV-absorbers, spacing agents, hardeners, and plasticizers.

Suitable additives for improving the dimensional stability of the photographic element are i.a. dispersions of a water-soluble or hardly soluble synthetic polymer e.g. polymers of alkyl (meth)acrylates, alkoxy(meth)acrylates, glycidyl (meth)acrylates, (meth)acrylamides, vinyl esters, acrylonitriles, olefins, and styrenes, or copolymers of the above with acrylic acids, methacrylic acids, Alpha-Beta-unsaturated dicarboxylic acids, hydroxyalkyl (meth)acrylates, sulphoalkyl (meth)acrylates, and styrene sulphonic acids.

Suitable UV-absorbers are i.a. aryl-substituted benzotriazole compounds as described in U.S. Pat. No. 3,533,794, 4-thiazolidone compounds as described in U.S. Pat. Nos. 3,314,794 and 3,352,681, benzophenone compounds as described in JP-A 2784/71, cinnamic ester compounds as described in U.S. Pat. No. 3,705,805 and 3,707,375 butadiene compounds as described in U.S. Pat. No. 4,045,229, and benzoxazole compounds as described in U.S. Pat. No. 3,700,455.

In general, the average particle size of spacing agents is comprised between 0.2 and 10 um. Spacing agents can be soluble or insoluble in alkali. Alkali-insoluble spacing agents usually remain permanently in the photographic element, whereas alkali-soluble spacing agents usually are removed therefrom in an alkaline processing bath. Suitable spacing agents can be made i.a. of polymethyl methacrylate of copolymers of acrylic acid and methyl methacrylate, and of hydroxypropylmethyl cellulose hexahydrophthalate. Other suitable spacing agents have been described in U.S. Pat. No. 4,614,708.

The following examples illustrate the processes herein disclosed.

EXAMPLE 1

A fully chemically sensitized fast monodisperse negative bromoiodide emulsion of 1 mole percent iodide content was prepared in the following manner.

75 g of gelatin were added to 1.500 ml of demineralised water with constant stirring at 500 rpm : the mixture was held for 30 minutes at room temperature and heated up to 60° C. This temperature was kept constant during the entire precipitation process.

24.5 g of methionine were added approximately five minutes before starting the precipitation and a few drops of a diluted mixture of 99% KBr and 1% KI were added.

240 ml of 2.94 N $AgNO_3$ (16% of the total amount of $AgNO_3$) were added under the following conditions:

during the first five minutes the flow of $AgNO_3$ was kept constant at 6 ml/min and a sufficient flow of a mixture of 99% KBr and 1% KI was added so as to keep the pAg constant at 6.94. During the following 21 minutes the flow of $AgNO_3$ was steadily increased from 6 ml/min up to 14.2 ml/min whereas the pAg was kept constant at 6.94 by regulating the flow of the mixture of KBr and KI. The latter was realised by means of an automated electronic control apparatus for silver halide preparation disclosed by Claes and Peelaers in Photographische Korrespondenz 102, Band Nr. 10/1967, p. 162.

Hereupon the pAg of the solution was increased from 6.94 to 9.44 as follows: the flow of $AgNO_3$ was ceased whereas during half a minute the flow of KBr/KI was held at 58.2 ml/min.

Then 360 ml of $AgNO_3$ (24% of the total amount of $AgNO_3$) were added under the following conditions:

during twenty minutes the flow of $AgNO_3$ was steadily increased from 14.2 up to 22 ml/min, whereas the pAg was kept constant at 9.44 by regulating the flow of the mixture of KBr and KI. The stirring speed was increased from 500 to 550 rpm.

Hereupon the pAg of the suspension was decreased from 9.44 to 7.7 as follows:

the flow of the mixture of KBr/KI was ceased whereas during half a minute the flow of $AgNO_3$ was kept at 72.6 ml/min.

The remaining portion of the total amount of $AgNO_3$ (60%) were added under the following conditions:

during 32 minutes the flow of $AgNO_3$ was steadily increased from 22 up to 34.5 ml/min whereas the pAg was kept constant at 6.94 by regulating the flow of KBr/KI. (The decrease in pAg from 7.7 to 6.94 occurred instantly upon the addition of $AgNO_3$ to the emulsion at the rate of 34.5 ml/min).

After five minutes the pH of the emulsion was reduced from 5.8 to 3.5 by adding a sufficient quantity of 6N sulfuric acid.

Hereupon the conventional photographic processes such as washing and chemical sensitization were applied to the emulsion.

The captioned emulsion was chemically sensitized for a period of 4 hours at 50° C. in the presence of sodium thiosulfate, p-toluene thiosulphonate and gold(III)chloride as noble-metal sensitizer.

At the conclusion hereof the emulsion was coated on a polyethylene terephthalate support and allowed to dry. Separate strips of this material were subsequently exposed through a grey continuous wedge to white light in a Herrnfeld Sensitometer and developed, some for 12 seconds and others for 33 seconds, in a developing bath of the following composition:

| | | |
|---|---|---|
| hydroquinone | 15 | g |
| phenidone | 0.9 | g |
| acetic acid 96% | 9.125 | ml |
| potassium carbonate | 16 | g |
| potassiummetabisulfite | 41.75 | g |
| potassium hydroxyde | 39 | ml |
| glutardialdehyde | 15 | ml |

-continued

| | |
|---|---|
| 1-phenyl-5-mercaptotetrazole | 10 mg |
| demineralized water up to | 1000 ml |
| Starter solution to be added: | |
| acetic acid 96% | 2.625 ml |
| KBr | 4 ml |
| KI | 0.01 ml |
| demineralized water up to | 40 ml |

Hereupon, the developed photographic strips were fixed in a conventional fixing bath comprising e.g. sodium thiosulfate and potassium metabisulfite, and then rinsed in water and allowed to dry.

The sensitometric properties of these film strips are indicated in Table II.

In this table the values figuring in the different columns have the following meaning: the values set forth in the first four columns show the sensitometric results in terms of fog speed, gamma and Dmax (maximum Density) of the photographic strips prepared as set forth above and developed in the developing bath of the composition set forth above during an overall developing time of 33 seconds.

The values for the speed are relative values corresponding to density 1 above fog. The speed obtained with the emulsion of the comparative Example I described hereinafter is given the reference value 100 (control). The other speed values are percent values in respect of the control.

The values given for gamma are the values of gradation measured from the characteristic curve over a density range of 1.5 starting from a density value of 0.25 above fog.

The last three columns of Table II show the difference in speed and the ratios for gamma and Dmax of the photographic strips prepared as set forth above and developed in the developing bath of the composition set forth above, during different processing times.

Under difference in speed is understood the difference between the speed of the strips processed during 33 seconds minus the speed of the strips processed during 12 seconds (expressed in percent value).

Under gamma ratio is understood the ratio of the gamma of the strips processed during 12 seconds over the gamma of the strips processed during 33 seconds.

Under Dmax ratio is understood the ratio of the Dmax of the strip processed during 12 seconds over the Dmax of the strip processed during 33 seconds.

The smaller the difference in speed and the closer the values of gamma and Dmax ratio to 1, the less dependent are the sensitometric values of the photographic strips on the processing time.

EXAMPLES 2 to 4

Bromoiodide emulsions were prepared according to the procedure described in Example 1, with the difference however that the portion of the total amount of $AgNO_3$ that is initially added at a constantly held pAg value of 6.94 is not 16% of the total amount of $AgNO_3$ added but resp. 10% (=Example 2), 30% (=Example 3), 50% (=Example 4). In each of the examples 2 to 4, the portion of the total amount of $AgNO_3$ subsequently added at the pAg value of 9.44, is 20%. The sensitometric results obtained with film strips coated with these emulsions are also indicated in Table II.

EXAMPLE 5

A bromoiodide emulsion was prepared according to the procedure described in Example 1, with the difference however that the total amount of $AgNO_3$ was added in successive portions of 20% of the total amount under the following pAg conditions:

initially 20% at a constantly held pAg value of 6.94,
subsequently 20% at a constantly held pAg value of 9.44,
subsequently 20% again at a constantly held pAg value of 6.94,
subsequently 20% again at a constantly held pAg value of 9.44,
finally the last 20% again at a constantly held pAg value of 6.94.

The sensitometric results obtained with film strips coated with this emulsion are also indicated in Table II.

COMPARATIVE EXAMPLE I

A bromoiodide emulsion was prepared according to the procedure described in Example 1, with the difference however that no pAg cycling took place, the total amount of $AgNO_3$ being added as follows.

During the first 5 minutes the flow of $AgNO_3$ was kept constant at 6 ml/min, the pAg of the solution being held at 6.94 by regulating the flow of the mixture of KBr and KI. Thereafter, the flow of $AgNO_3$ was steadily increased from 6 to 34.55 ml/min whereas the pAg was kept invariably at 6.94 by regulating the flow of the mixture of KBr and KI.

The sensitometric results obtained with films prepared according to this procedure are indicated at the bottom of Table II.

EXAMPLE 6

A bromoiodide emulsion was prepared according to the procedure described in Example 1, with the difference however that sodium 3-carboxylate-o-methyl-5-(1,4-dihydro-1-ethylpyridylidene)rhodanine was added as spectral sensitizer.

The sensitometric results obtained with the film prepared according to this procedure are indicated in Table III.

COMPARATIVE EXAMPLE II

A bromoiodide emulsion was prepared according to the procedure described in comparative example I, with the difference however that sodium 3-carboxylate-o-methyl-5-(1,4-dihydro-1-ethylpyridylidene)rhodanine was added as spectral sensitizer.

The sensitometric results obtained with the film prepared according to this procedure are indicated in Table III.

The results set forth in Tables II and III show that in comparison with materials as used in the Comparative Examples photographic materials prepared according to the present invention show a lower fog value and in general significantly greater ratios for gamma and Dmax, the latter phenomenon implying that the sensitometric properties of the photographic Materials prepared according to the invention show less variation in function of the degree of development.

TABLE I

| Temperature | pAg neutrality | pAg for cubic crystals formation | pAg for octahedral crystals formation | change-over pAg-value |
|---|---|---|---|---|
| 80° C. | 5.0 | 6.5 | 8.8 | 7.7 |
| 60° C. | 5.4 | 7 | 9.4 | 8.2 |
| 40° C. | 5.8 | 7.5 | 10.1 | 8.8 |
| 20° C. | 6.3 | 8.0 | 10.9 | 9.5 |

TABLE II

| Example | Fog | Speed | Gamma | $D_{max}$ | Difference in speed | Gamma ratio | Dmax ratio |
|---|---|---|---|---|---|---|---|
| 1 | 0.046 | 87 | 3.13 | 3.88 | 21 | 0.9457 | 0.9531 |
| 2 | 0.066 | 85 | 3.16 | 4.06 | 21 | 0.9019 | 0.8713 |
| 3 | 0.050 | 81 | 3.06 | 3.80 | 21 | 0.9216 | 0.9113 |
| 4 | 0.053 | 74 | 3.22 | 4.03 | 21 | 0.9130 | 0.8726 |
| 5 | 0.030 | 95 | 3.09 | 3.62 | 21 | 0.9256 | 0.8629 |
| Comp. I | 0.083 | 100 | 3.05 | 4.06 | 21 | 0.8623 | 0.8399 |

TABLE III

| Example | Fog | Speed | Gamma | $D_{max}$ | Difference in speed | Gamma ratio | Dmax ratio |
|---|---|---|---|---|---|---|---|
| 6 | 0.112 | 85 | 2.78 | 4.091 | 31 | 0.9136 | 0.7330 |
| Comp. II | 0.220 | 100 | 2.91 | 4.095 | 36 | 0.8831 | 0.7731 |

We claim:

1. A method for preparing a silver halide emulsion which comprises the step of precipitating silver halide grains in an aqueous solution of peptizer initially and finally under pAg values suitable for forming cubic silver halide crystals characterized in that at least once during the precipitation stage the pAg is increased for at least 10 percent by weight of the total amount of silver salt used during the precipitation by at least 1.5 units to such value whereby the formation of octahedral crystals would occur if that value were to persist over the entire precipitation stage, and that during the entire precipitation the pAg value is maintained about the pAg neutrality value.

2. A method according to claim 1, wherein the initial and final pAg value is situated one to two units below the change-over value and the pAg value is increased at least once during the precipitation stage to one to two units above the change-over value.

3. A method according to claim 2, wherein the initial and final pAg value is situation between 6.5 and 8 and is increased at least once during the precipitation stage to a value situated between 8.5 and 11.

4. A method according to claim 1, wherein the increase of the pAg value is brought about after precipitation of between ten and twenty percent of the total mount of silver halide to be precipitated.

5. A method according to claim 1, wherein the pAg value is alternatively increased, resp. decreased each time after precipitation of between about ten and twenty percent of the total amount of silver halide to be precipitated.

6. A method according to claim 1 wherein the pAg conditions are controlled by regulating the flow of alkali metal salt to the aqueous solution of peptizer.

7. A method according to claim 1 wherein the resulting silver halide emulsion is a silver bromoiodide emulsion.

8. A method according to claim 1 in which a spectral sensitizing dye is caused to be present in the photographic silver halide emulsion.

9. Light-sensitive gelatino-silver halide photographic emulsions prepared as claimed in claim 1.

10. Photographic materials whenever containing silver halide emulsions prepared as claimed in claim 1.

* * * * *